US006616418B1

(12) United States Patent
Taylor

(10) Patent No.: US 6,616,418 B1
(45) Date of Patent: Sep. 9, 2003

(54) VAPOR EVACUATION DEVICE

(75) Inventor: Ernest Taylor, Baton Rouge, LA (US)

(73) Assignee: CNE Mobile Scrubber Systems, LLC, Baton Rouge, LA (US)

( * ) Notice: Subject to any disclaimer, the term of this patent is extended or adjusted under 35 U.S.C. 154(b) by 0 days.

(21) Appl. No.: 10/288,216

(22) Filed: Nov. 5, 2002

Related U.S. Application Data

(63) Continuation-in-part of application No. 10/087,326, filed on Mar. 1, 2002.

(51) Int. Cl.[7] ..... F04F 19/24
(52) U.S. Cl. ..... 417/54; 417/234
(58) Field of Search ..... 417/234, 151, 417/182, 187, 54, 53

(56) References Cited

U.S. PATENT DOCUMENTS 509,400 A * 11/1893 Ruble ..... 417/151
3,544,010 A * 12/1970 Jurdye ..... 239/168
3,823,872 A * 7/1974 Frenzl ..... 239/8
4,545,739 A * 10/1985 Nicodemus ..... 417/152
4,580,948 A * 4/1986 Schmidlin ..... 417/54
4,616,979 A * 10/1986 Hynes et al. ..... 417/231
4,673,335 A * 6/1987 Nicodemus ..... 417/54
4,725,201 A * 2/1988 Nicodemus ..... 417/54
4,773,827 A * 9/1988 Zaiser ..... 417/183
4,781,537 A * 11/1988 Nicodemus et al. ..... 417/54
6,019,820 A * 2/2000 Leverett ..... 95/216
6,109,882 A * 8/2000 Popov ..... 417/53
6,155,794 A * 12/2000 Wu ..... 417/151
6,164,567 A * 12/2000 Popov ..... 239/428.5
6,364,628 B1 * 4/2002 Potts et al. ..... 417/234

* cited by examiner

*Primary Examiner*—Charles G. Freay
*Assistant Examiner*—William H. Rodriguez
(74) *Attorney, Agent, or Firm*—Roy, Kiesel, Keegan & DeNicola

(57) ABSTRACT

A method and system for evacuating vapors from a vessel comprising at least one fluid line which can have a pump configured to draw a water and/or air mixture which is combined with vapors vacuumed from a tank via another inlet, yielding a solution that can then be disposed as a liquid. Vacuum at the inlet is created by the flowing of the water or air/water mixture past the inlet. The reduced pressure of the moving liquid causes a pressure differential with the higher pressure within the tank, and thus the vapors migrate into the vapor evacuation assembly, are mixed with the fluid, and can then be disposed, or continually recycled, with the fumes stored for later disposal.

17 Claims, 5 Drawing Sheets

VAPOR EVACUATION DEVICE

CONTINUATION HISTORY

This application is a continuation in part of U.S. application Ser. No. 10/087,326, filed on Mar. 1, 2002, pending, which is hereby incorporated by reference in its entirety.

BACKGROUND OF THE INVENTION

The present invention relates-to the evacuation of hazardous and/or harmful vapors from a tanker vehicle. These vapors are typically vented into the atmosphere where they can cause environmental problems, or stored in the tanker vehicle where they can pose a danger, especially if they are flammable and/or volatile.

OBJECTS OF THE INVENTION

One object of the invention is to provide a vapor evacuation device that can evacuate vapors from tanker vehicles.

Another object of this invention is to provide a vapor evacuation device which combines harmful vapors into an easily disposable liquid and/or air stream.

Still another object of the invention is to provide a vapor evacuation device which is portable.

Still another object of the invention is to provide a vapor evacuation device that is able to recycle the water used to evacuate the vapors.

Other objects and advantages of this invention shall become apparent from the ensuing descriptions of the invention.

SUMMARY OF THE INVENTION

According to the present invention, the vapor evacuation device comprises at least one fluid line which can have a pump configured to draw a water and/or air mixture which is combined with vapors vacuumed from a tank via another inlet, yielding a solution that can then be disposed as a liquid. Vacuum at the inlet is created by the flowing of the water or air/water mixture past the inlet. The reduced pressure of the moving, liquid causes a pressure differential with the higher pressure within the tank, and thus the vapors migrate into the vapor evacuation assembly, are mixed with the fluid, and can then be disposed, or continually recycled, with the fumes stored for later disposal.

BRIEF DESCRIPTION OF THE DRAWINGS

The accompanying drawings illustrate an embodiment of this invention. However, it is to be understood that this embodiment is intended to be neither exhaustive, nor limiting of the invention. They are but examples of some of the forms in which the invention may be practiced.

DETAILED DESCRIPTION OF EXEMPLARY EMBODIMENTS

Figure 1:
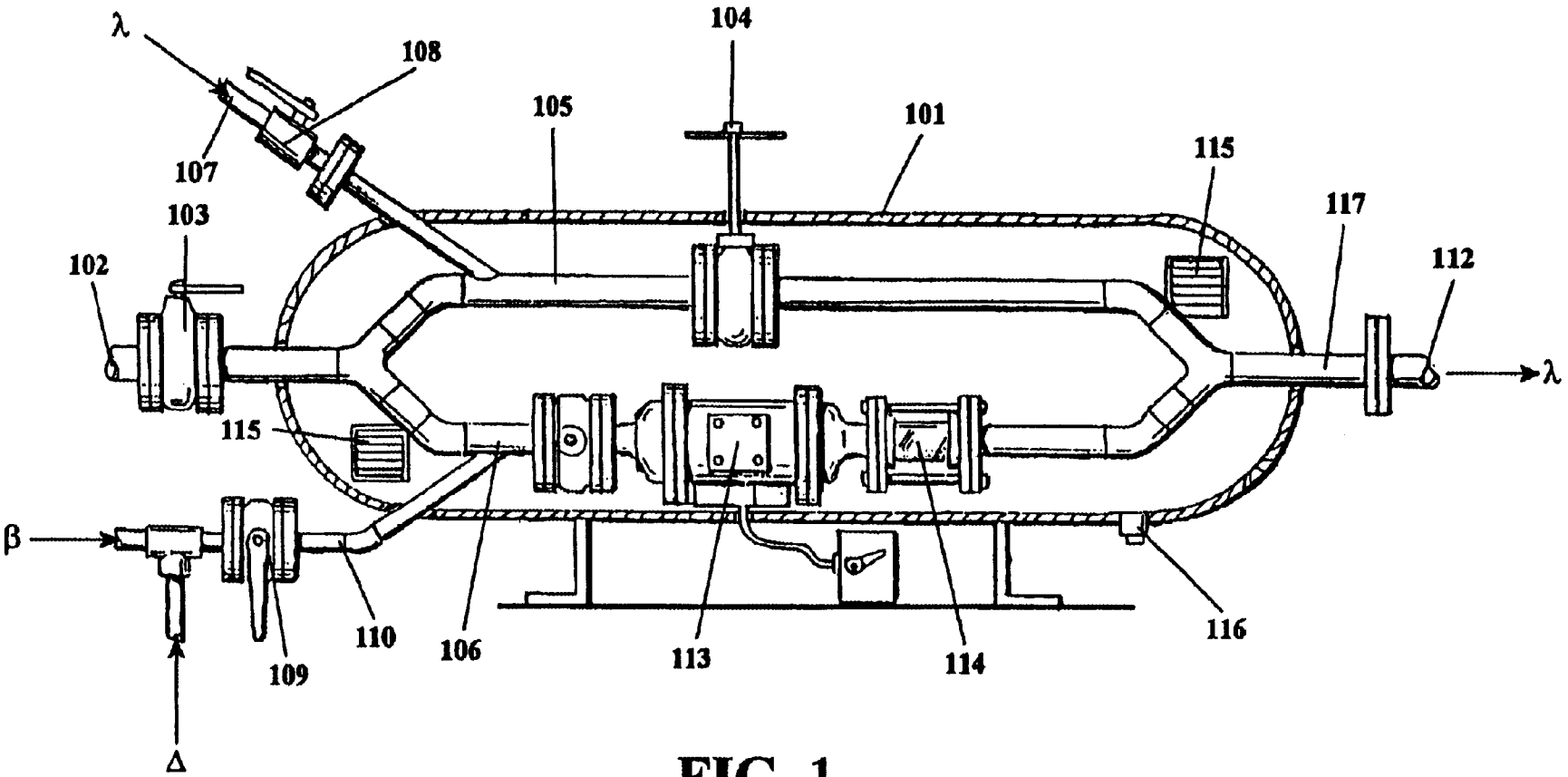
FIG. 1 shows a diametrical longitudinal cross section of an exemplary embodiment of a vapor evacuation device.
Figure 2:
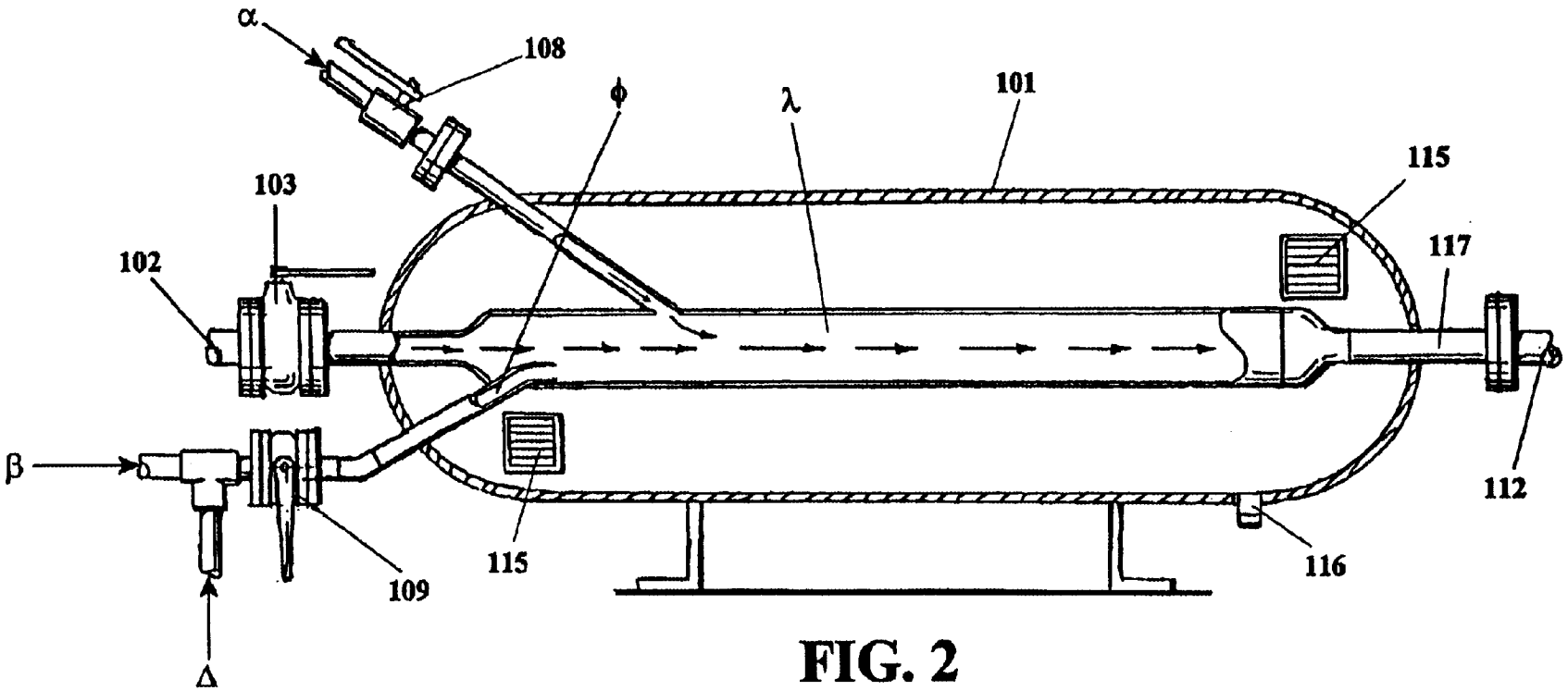
FIG. 2 shows a diametrical longitudinal cross section of another exemplary embodiment of a vapor evacuation device.
Figure 3A:
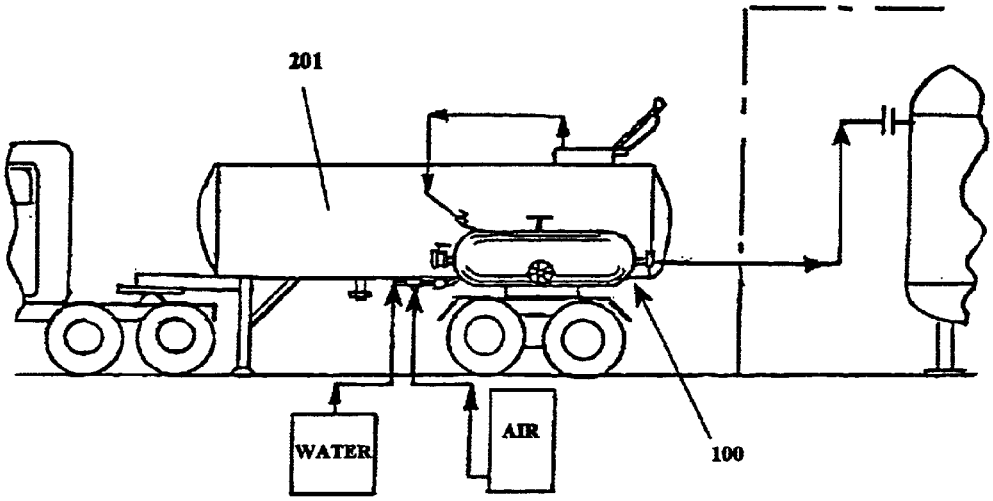
FIG. 3A shows an elevational view of a vapor evacuation device configured as part of a tanker truck.
Figure 3B:
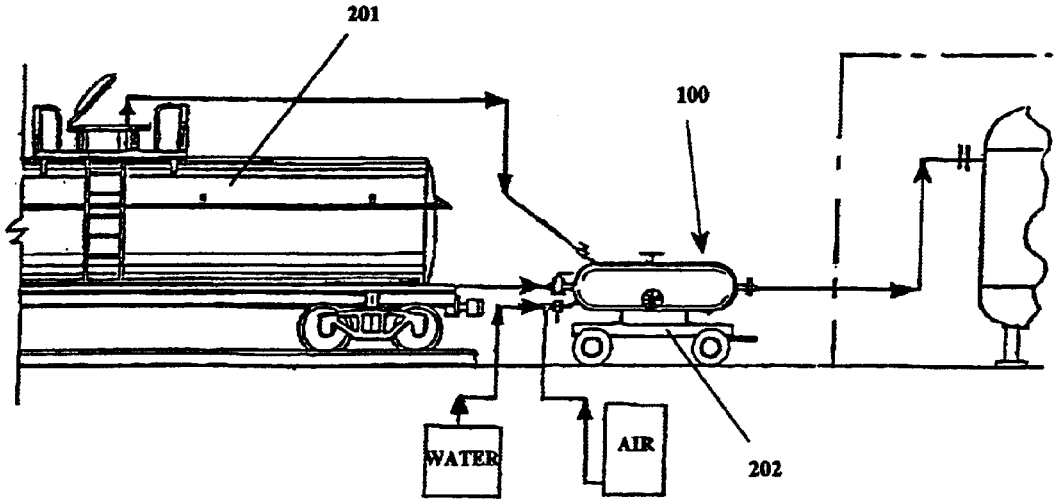
FIG. 3B shows an elevational view of a vapor evacuation device configured as a standalone trailer and in use with a rail tanker car.
Figure 5:
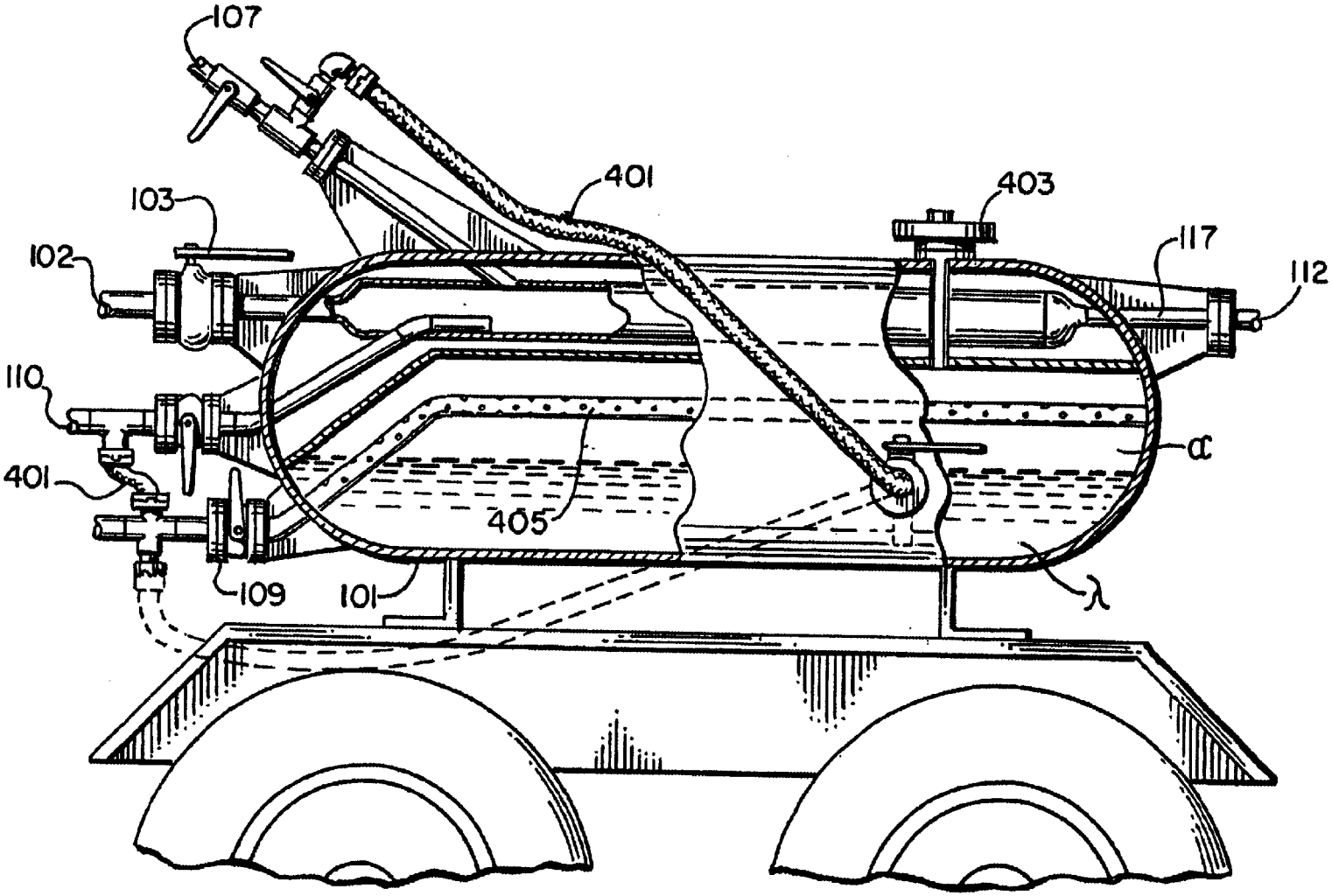
FIG. 5 shows a side view of a recirculating vapor evacuation device Comprised in a single tank configuration.

Without any intent to limit the scope of this invention, reference is made to the figures in describing the various embodiments of the invention. Referring to FIGS. 1, through 5, a vapor evacuation system 200 comprising:

1. A vapor containing vessel 201, which would contain gaseous or liquid chemicals or other products which will often leave vaporous residue in vessel 201 when evacuated;
2. A chassis 202 which may have wheels, skids, rails, tracks or any other mobility-creating device, the purpose of which is to enable the vessel to be moved around. Examples of such a chassis could be a trailer, a cart, a rail car, a sled or any similar device. The chassis might also be self-propelled, such as with a motor, sails or any method of locomotion. Examples of such a chassis would be a truck, a car, a locomotive, a van, or other vehicle. Alternately, the chassis can be buoyant, making a barge, boat or other seagoing vessel into a mobile, flotational vapor evacuation system 200; and
3. A vapor evacuation device 100 is provided for the removal of the vapors from vessel 201. An embodiment of such a vapor evacuation device 100 is illustrated in FIG. 1, comprising an outer housing 101 which may be used to protect and to conceal the inner workings of the device. In one embodiment, a fluid passageway 117 may consist of a first aperture 110 in which air $\Delta$ and/or water $\beta$ will be introduced into fluid passageway 117 creating a mixture $\phi$. A second aperture 112 will be located downstream of said first aperture 110 and may be connected to a wastewater line or other such disposal outlet. A third aperture 107 is connected to a vapor source, for example, the vapor vent of a tanker truck or other vessel 201.

In a recirculating configuration, such as the single-tank design shown in FIG. 5, first aperture 110 can be attached to third aperture 107 via a recirculating connection 401 to permit recirculation of vapor and air/water mixture $\lambda$ so that no disposal need take place at the offloading facility. Recirculating connection 401 can be any type of pipe, tubing, conduit or the like which will transport vapor and air/water mixture $\lambda$. At least some portion of recirculating connection 401 will be perforated portion 405, such that gas and liquid are permitted to escape from recirculating connection 401 into housing 101. The net effect of perforated portion 405 is that vapors $\alpha$ will escape from vapor and air/water mixture $\lambda$ and reside in housing 101 until they are able, or desired to be offloaded. This will enable the reuse of the of vapor and air/water mixture $\lambda$ to evacuate vapors from vessel 201, as detailed below. Note that depending upon application that recirculating connection 401 can be attached either to third aperture 107 or to first aperture 110 and then to the base of housing 101 which holds vapor and air/water mixture $\lambda$. A configuration connected to first aperture 110 is used when there is no pressure left in vessel 201.

Figure 4:
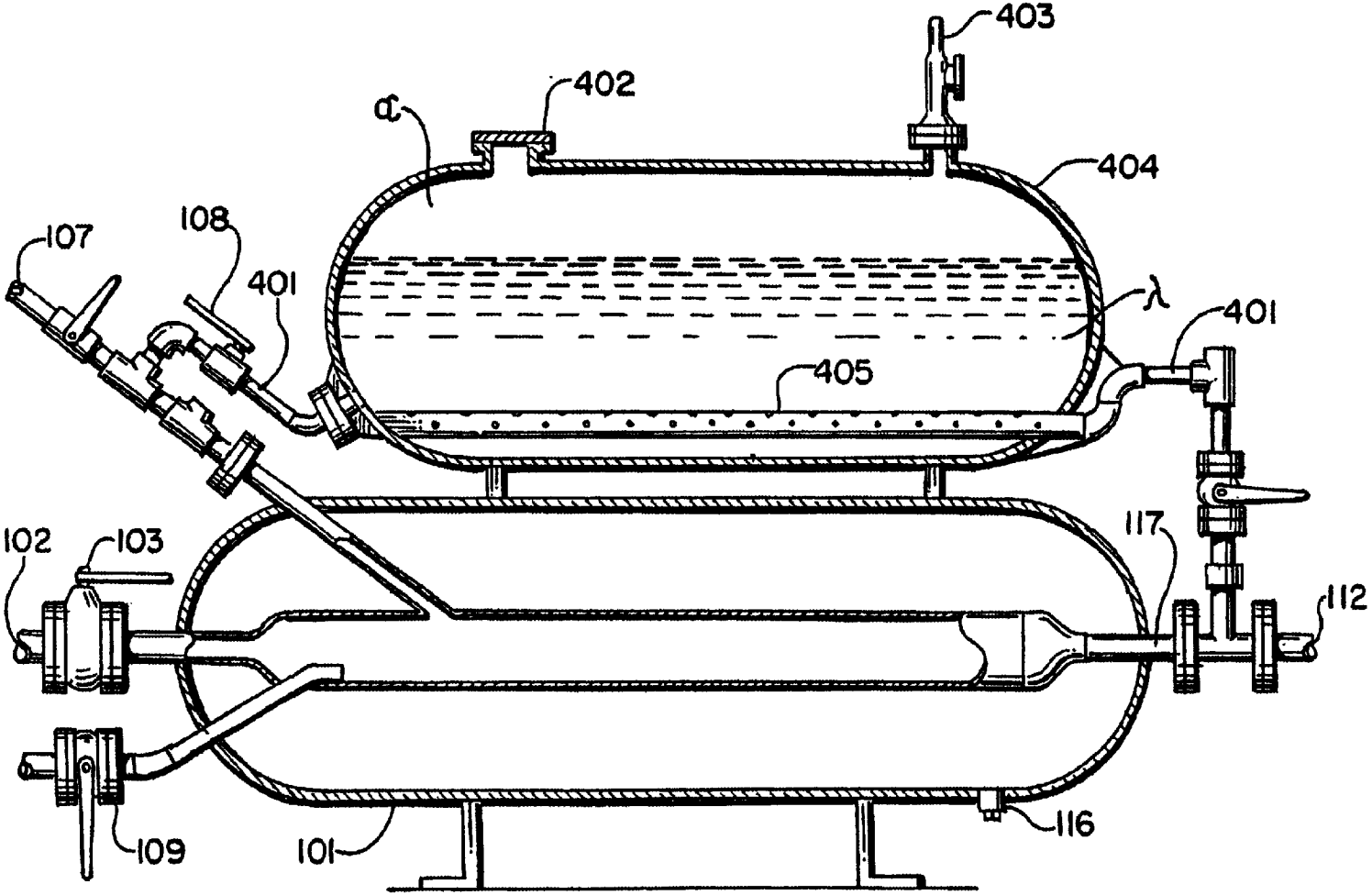
FIG. 4 shows a side view of a recirculating vapor evacuation device comprised in a dual tank configuration.

If a dual tank design such as the design in FIG. 4 is desired, the same basic mechanical concept is present, but there is the addition of recirculating tank 404. Recirculating tank 404 would thus serve the same functions as recirculating connection 401 and as housing 101, as well as contain perforated portion 405. Such a two-tank design may be helpful for various reasons, such as retrofitting an older model or less-expensively designed model at a later time.

Operation may be achieved in multiple ways, one of which can be to feed a fluid comprised of air Δ or water β, or some mixture thereof, into first aperture 110 to cause a vacuum at third aperture 107 which, in turn, draws vapors α out of vessel 201 and into fluid passageway 117 where vapors are combined with the air/water mixture ϕ to create a disposable vapor and air/water mixture λ. This effect is explained by the Bernoulli principle, which describes the phenomenon that when the flow rate of a fluid increases, the pressure within that fluid decreases. The net effect of a lower pressure within the fluid and a higher pressure within vessel 201 is a vacuum at third aperture 107, which increases proportionately to the flow rate within the vapor evacuation device. It is this pressure differential which causes vapors to flow from vessel 201 to fluid passageway 117. Vapor and air/water mixture λ is subsequently expelled through second aperture 112 for disposal, or it can be recirculated, as described in more detail below.

Recirculation of vapor and air/water mixture λ can be performed while evacuating so that no disposal need take place at the offloading facility. This is accomplished by cycling vapor and air/water mixture λ through recirculating connection 401 between first 110 and third apertures 107. A portion of recirculating connection 401 is encased within outer housing 101 so as to permit the collection of air/water mixture ϕ. This same portion of recirculating connection 401 or a portion thereof is perforated so that as vapor and air/water mixture λ cycles through recirculating connection 401, vapors α will be able to separate from the vapor and air/water mixture λ leaving air/water mixture ϕ to cycle back in through first aperture 110, where it can collect additional vapors α, thus recirculating the fluid.

Various substances may be added to air/water mixture ϕ within tank to achieve assorted results, such as odor control, neutralization and the like by adding selected chemicals through access door 402. Such chemicals may also be added via other valves previously mentioned, if desired or needed. Additionally, since vapors α will build over the course of recirculating, a pressure relief valve 403 can also be employed to prevent explosion, or enable the user to "bleed off" some pressure if needed. This arrangement can be designed in multiple ways, such as those in the FIGS. Two notable examples are the two-tank design as in FIG. 4, or the single-tank design as in FIG. 5.

The progress of the moving product through the assembly can be monitored by operatively affixing a sight glass 114 in fluid passageway 117 so that the moving product can be viewed. This is useful for confirming whether product is moving through the apparatus as desired. Additionally, a drain 116 may be mounted in the wall of the housing to permit evacuation of liquids within the housing.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A vapor evacuation device for removing vapors from a vessel comprising:

A fluid passageway having a first aperture configured to permit the introduction, of a fluid into said fluid passageway, said fluid passageway further comprising a second aperture positioned downstream from said first aperture, whereby fluid entering said passageway will flow from said first aperture toward said second aperture, said fluid passageway further comprising a third aperture configured to provide fluid communication between said vessel and said fluid passageway, whereby fluid flowing from said first aperture toward said second aperture will draw vapors from said vessel into said fluid passageway, said vapor evacuation device further comprising a fluid connection between said first aperture and said third aperture whereby fluid can be recirculated through said fluid passageway.

2. A vapor evacuation device according to claim 1 wherein said fluid connection is partially a perforated conduit through whose perforations fluid and gas may escape.

3. A vapor evacuation device according to claim 2 wherein said fluid is selected from the group comprising air, water and combinations thereof.

4. A vapor evacuation device according to claim 3 further comprising a mobile chassis upon which said vapor evacuation device is mounted.

5. A vapor evacuation device according to claim 4 further comprising a sight glass positioned downstream from said pump, said sight glass configured to provide a view of the contents of said fluid passageway.

6. A vapor evacuation device according to claim 5 further comprising a housing substantially enclosing said vapor evacuation device.

7. A vapor evacuation device according to claim 6 further comprising a pressure relief valve positioned in said housing through which excess vapors can be evacuated.

8. A vapor evacuation device according to claim 7 further comprising a drain positioned to permit liquid that may become trapped within said housing to drain therefrom.

9. A vapor evacuation device according to claim 8 wherein said mobile chassis comprises a frame and a plurality of wheels operatively connected thereto.

10. A vapor evacuation system comprising:

a. a mobile chassis;

b. a vessel mounted on said chassis; and c. a vapor evacuation device as described in claim 1 mounted on said chassis for removing vapors from said vessel.

11. A vapor evacuation system comprising:

a. a buoyant chassis;

b. a vessel mounted on said buoyant chassis; and c. a vapor evacuation device as described in claim 1 mounted on said buoyant chassis for removing vapors from said vessel.

12. A method of evacuating vapors from a vessel using a vapor evacuation device as described in claim 1, comprising: passing fluid selected from the group comprising air, water and combinations thereof through said fluid passageway whereby the flow of said fluid through said passageway will draw said vapors from said vessel through said aperture into said passageway.

13. A method of evacuating vapors from a vessel according to claim 12 further comprising combining said vapors with said fluid.

14. A method of evacuating vapors from a vessel according to claim 13 further comprising recirculating said combination through said device.

15. A vapor evacuation device for removing vapors from a vessel comprising a:

i. housing;

ii. a fluid passageway configured substantially within said housing comprising:

1. a first aperture configured to permit the introduction of a fluid into said fluid passageway;
2. a second aperture positioned downstream from said first aperture, whereby fluid entering said passageway will flow from said first aperture toward said second aperture;
3. a third aperture configured to provide fluid communication between said vessel and said fluid passageway; and iii. a mobile chassis upon which said housing may be mounted.

16. A vapor evacuation device according to claim 15 wherein said second aperture of said fluid connection is a series of perforations through which fluid and gas may escape.

17. A method of evacuating vapors from a vessel using a vapor evacuation device as described in claim 16, comprising: introducing a desired amount of fluid selected from the group comprising air, water and combinations thereof through said fluid passageway, wherein said fluid is permitted to flow from said fluid passageway through said second aperture into said housing, subsequently into said fluid.

* * * * *